US006601416B1

(12) United States Patent
Sanders

(10) Patent No.: US 6,601,416 B1
(45) Date of Patent: Aug. 5, 2003

(54) NOTEBOOK COMPUTER SECURITY LEVER LOCKING ASSEMBLY

(76) Inventor: Richard Sanders, 29 Harwich Cir., Westwood, MA (US) 02090

( * ) Notice: Subject to any disclaimer, the term of this patent is extended or adjusted under 35 U.S.C. 154(b) by 0 days.

(21) Appl. No.: 10/120,001

(22) Filed: Apr. 10, 2002

(51) Int. Cl.[7] ..... E05B 69/00; E05B 73/00

(52) U.S. Cl. ..... 70/58; 70/30; 70/14; 70/57.1; 70/49

(58) Field of Search ..... 70/58, 57.1, 14, 70/30, 49, 232, 18, 19, 32, DIG. 57; 248/551–553; 361/732

(56) References Cited

U.S. PATENT DOCUMENTS 3,820,283 A * 6/1974 Acerra et al. ..... 49/449
5,327,752 A * 7/1994 Myers et al. ..... 70/58
5,381,685 A * 1/1995 Carl et al. ..... 70/58
5,502,989 A * 4/1996 Murray et al. ..... 70/58
5,687,592 A * 11/1997 Penniman et al. ..... 70/14
5,875,657 A * 3/1999 Kelley ..... 70/18
5,913,907 A * 6/1999 Lee ..... 70/58
6,199,413 B1 * 3/2001 McDaid et al. ..... 70/58
6,205,824 B1 * 3/2001 Miao ..... 70/58
6,244,080 B1 * 6/2001 Sakurai ..... 70/14
6,305,199 B1 * 10/2001 Igelmund ..... 70/58
6,401,502 B1 * 6/2002 Yang ..... 70/30
6,463,770 B1 * 10/2002 Lee ..... 70/58

* cited by examiner

*Primary Examiner*—Anthony Knight
*Assistant Examiner*—John B. Walsh
(74) *Attorney, Agent, or Firm*—John P. McGonagle

(57) ABSTRACT

A lock with a cam action joined to a cylindrical assembly with a front portion adapted to being inserted into a computer chassis security slot. The cylindrical assembly front portion is comprised of two fixed prongs and a lever each terminating in a hook. The lever is pivotally attached to the cylindrical assembly and is pivoted within the security slot by the cam action of the lock.

7 Claims, 8 Drawing Sheets

NOTEBOOK COMPUTER SECURITY LEVER LOCKING ASSEMBLY

BACKGROUND OF THE INVENTION

This invention relates to security apparatus, and more particularly to apparatus for securing notebook computer equipment.

In recent years there has been a marked increase in the amount of computer equipment used in business and at home. Not only have the number of computers increased, but their size has become steadily smaller. Computer owners carry with them and use in areas with public access smaller computers such as laptop and notebook computers. Notebook computers only weigh several pounds or less and are easily concealed on the person or in a carry bag. Equipment items in this category generally have values from one to several thousands of dollars, and are easily marketed. Equipment such as this and their component:parts are, therefore, attractive, lucrative and easy targets for thieves.

Many personal computers have a security slot in an external wall. Attempts to provide securing devices centered on this slot have been complicated. An example of this may be found in U.S. Pat. No. 5,502,989 (Reexamination Certificate B1 5,502,989), issued to W. R. Murray, Jr., et al. The Murray device, inter alia, provides a security device comprised of a housing with a slot engagement portion, said portion being rotatable between an unlocked position and a locked position, and a pin coupled through the housing and extending into the security slot member after said slot engagement member is in said locked position. The Murray device is specifically designed to engage a rectangular security slot. Another approach has been used in U.S. Pat. No. 5,983,679 issued to G. Reyes. The Reyes device uses a cam assembly with a single hook arm in conjunction with two prongs to engage with the predefined rectangular security slot.

SUMMARY OF THE INVENTION

The present invention provides a relatively simple locking mechanism for preventing the theft of a small computer, such as a notebook computer. The locking mechanism of the present invention is adapted to fit all computers made by all manufacturers, which contain a security slot in their chassis, regardless of the configuration of the security slot.

To attain this, the present invention provides lock with a cam action joined to a cylindrical assembly with a front portion adapted to being inserted into a computer chassis security slot. The cylindrical assembly front portion is comprised of two fixed prongs and two levers each terminating in a hook. Each lever is pivotally attached to the cylindrical assembly and is pivoted in a scissors motion within the security slot by the cam action of the lock. The present invention replaces the complications inherent with the removable coupling pin of the Murray invention and eliminates the need for rotating the entire assembly in order to be positioned with a locked position. The present invention provides a sturdier locking configuration than the Reyes device. The present invention is capable of engaging a security slot having other than a rectangular configuration, a decided advantage over both the Murray and Reyes devices. The unique design of the present invention makes the present invention an ideal choice for the individual or organization that has a variety of computer brands to secure. A lockable cable engages the cylindrical assembly. The cable is secured to a fixed object to prevent the computer from being stolen or removed from a fixed location. In the present invention a variety of different type locking cables may be used.

Accordingly, it is an object of the present invention to provide a computer security locking apparatus for securing small computers, such as notebook computers, which have security slots in their chassis. It is additionally an object of the present invention to provide such an apparatus which is simple, economical, easy to use and quickly installed.

Another object of the invention is to provide such a security apparatus which is installed to said computer without modifying the computer chassis thereby removing the risk of contacting various components and circuitry therewithin.

It is another object of the present invention to provide a security apparatus which may use different types of anchoring cables.

It is an object of the invention to provide a security apparatus which does not require rotation between locked and unlocked positions.

It is still another object of the invention to provide a security apparatus which is activated by a cam lock action.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1A:
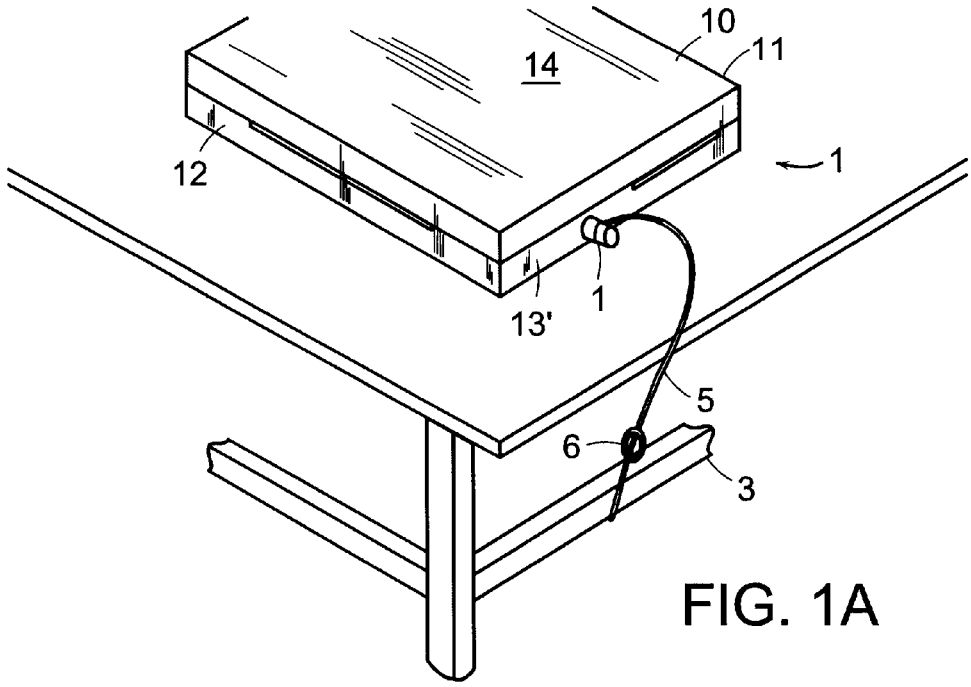
FIG. 1A is a perspective view.of the invention, with a travel anchor cable, installed on a notebook computer, thereby securing the notebook computer to a table.

Referring to the drawings in detail wherein like elements are indicated by like numerals, there is shown an embodiment of the notebook computer security lever locking assembly 1 of the present invention. The invention 1 provides a cylindrical assembly 50 joined to a cam lock assembly 20 and an anchored locking cable 5. In the examples shown, the computer 10 is a notebook computer. The computer 10 secured could be a smaller or a larger personal computer. The computer 10 has a generally rectangular configuration, with a front outer wall 11, rear outer wall 12, two outer side walls 13, a top 14, and a bottom 15. One of the computer sides 13' has an open security slot 16 formed therein. For exposition purposes, the security slot 16 has a generally rectangular configuration. However, the present invention will work well with any security slot configuration, e.g., square, circular, oval, etc. The security slot long edges 17 define the security slot's longitudinal axis. In this embodiment, the security slot short edges 18 are parallel to the computer chassis top 14 and bottom 15. The locking cable 5 is inserted into the cylindrical assembly 50. The forward end 51 of the cylindrical assembly 50 is inserted into the open security slot 16. Manipulation of the cam lock assembly 20 locks the cylindrical assembly to the computer 10. The locking cable 5 is fastened to an appropriate secure object such as a table leg 3.

The cylindrical assembly 50 is comprised of a hollow cylindrical encasement element 60, a hollow cylindrical collar element 90, and an optional, resilient buffer washer 55. The encasement element 60 and collar element 90 have concentric central axes which also define their longitudinal axes. The encasement element 60 has two ends, one termed the entry end 61 and the other termed the exit end 62. The encasement element 60 is shaped and formed by a cylindrically curved, wall 63, preferably made from metal, extending from the entry end 61 to the exit end 62. The encasement element entry end 61 is open. The entry end 61, exit end 62 and wall 63 define a hollow interior 64. The wall 63 has an exterior surface 65 and an interior surface 66. The encasement element exit end 62 is closed with a flat end wall 67 having a small, central, elongated opening 68 therein. The end wall 67 has two externally protruding, parallel members 70, each positioned centrally adjacent an opposite elongated opening 68 long edge. Each protruding member 70 has an end 71 attached to the end wall 67 and an opposite free end 72. The protruding member 70 has a longitudinal axis defined from attached end 71 to opposite free end 72. The longitudinal axis of the protruding member 70 is perpendicular to the plane of the end wall 67 and parallel to the cylindrical encasement element 60 longitudinal central axis. The encasement element 60 has a circular opening 74 formed in its wall 63. The opening 74 is a small, threaded opening, into which a threaded plug 75 may be fitted. The encasement element 60 has a relatively deep, radial channel 76 formed in the wall exterior surface 65 near to the encasement element exit end 62. The channel 76 has a width equal to approximately one quarter of the encasement element 60 length along the encasement element longitudinal axis. The encasement element 60 also has three, relatively shallow, radial channels formed in the wall exterior surface 65, one 77 forward near to the deep channel 76, a second 78 between the first channel 77 and the encasement element entry end 61, and the third 79 rearward toward the encasement element entry end 61. The shallow channels 77, 78, 79 are adapted to receive an "O" ring 53.

The encasement element interior 64 is formed into two sections, the entry end interior 58 and exit end interior 59. The exit end interior 59 is that portion of the encasement element defined by the radial channel 76 and exit end 62. The diameter of the exit end interior 59 is less than the diameter of the entry end interior 58.

The encasement element 60 has two elongated lever elements 80 positioned between the two externally protruding, parallel members 70, extending through the exit end opening 68 into the encasement element interior 64. The lever elements 80 are pivotally pinned in position by a pin 81 extending through the radial channel portion 76 of the encasement wall 63. Each lever 80 has a body 85 defined by rearward end 83 positioned within the encasement element interior 64 and a forward end 82 protruding out of the encasement element between the protruding members 70 and terminating in a half crossbar 84 giving the lever 80 the general shape of an inverted "L". Each lever 80 has a longitudinal axis defined by the rearward end 83 and the forward end 82. The longitudinal axis of each lever 80 in an unlocked positioned is generally perpendicular to the plane of the end wall 67 and parallel to the cylindrical encasement element 60 longitudinal central axis. Each lever body 85 has a generally rectangular cross-section. Each lever rearward end 83 terminates in a cylindrical shaft 86 with a central axis coincident with the longitudinal central axis of the lever 80. Each lever body 85 has an aperture 87 formed through it at each lever's approximate longitudinal midpoint. Each lever 80 is adapted to pivotally rotate about the pin 81 positioned through the aperture 87, one lever pivoting in one direction and the other lever pivoting in an opposite direction, thereby forming a scissor crossing effect. The body 85 of each lever element 80 is substantially contained within the encasement element exit end interior 59. Each lever cylindrical shaft 86 protrudes into the encasement element entry end interior 58.

The cylindrical assembly 50 is further comprised of a hollow, cylindrical collar element 90. The collar element 90 has two ends, one termed the entry end 91 and the other termed the exit end 92, the entry end 91 and exit end 92 defining a collar element longitudinal axis. The collar element 90 is shaped and formed by a cylindrically curved, wall 93 extending from the entry end 91 to the exit end 92. The wall 93, entry end 91 and exit end 92 define a collar element interior 94. The collar element entry end 91 is open. The wall 93 has an interior surface 95 and an exterior surface 96. The wall interior surface 95 has a radial diameter slightly larger than the radial diameter of the encasement element wall exterior surface 65. The collar interior wall surface 95 has three interior, radial flanges 97, 98, 99 formed therein. The first flange 97 is positioned at the collar element entry end 91. The second flange 98 is formed approximately one-third of the length along the longitudinal axis from the entry end 91 toward the exit end 92. The third flange 99 is formed approximately two-thirds of the length along the longitudinal axis from the entry end 91 toward the exit end 92. The collar element wall 93 has a keyhole-shaped opening 100 formed therein, said opening 100 having a circular portion 101 and a generally rounded, rectangular portion 102. The keyhole 100 longitudinal axis is parallel to the collar element 90 longitudinal axis. The keyhole circular portion 101 is closest to the collar element entry end 91 and the keyhole rectangular portion 102 is closest to the collar element exit end 92. The collar element exit end 92 is partly closed with an end wall 103 having a central circular opening 104 formed therein.

Before assembling the encasement element 60 and collar element 90, a resilient buffer washer 55 may be fitted over the encasement element protruding members 70. The washer provides a cushioned feel while inserting the lock 1 into the computer security slot 16, as well as acting as a spring element within the collar element 90 operating to push against the computer chassis side wall 13 and security slot 16 thereby exerting force tending to draw the protruding members 70 and lever elements 80 back into the cylindrical assembly 50. The lever half cross bars 84 are thereby held snugly up against the inside of the security slot 16. The collar element entry end 91 is placed over the encasement element exit end 62 and partly over the encasement element wall exterior surface 65 so that the encasement element protruding members 70 and lever forward ends 82 protrude through the collar element end wall circular central opening 104. The buffer washer 55 is thereby sandwiched between the encasement element end wall 67 and the collar element end wall 103 within the collar element interior wall surface 95. The encasement and collar elements 60, 90 are fitted so that the collar element keyhole opening 100 is positioned over the encasement element radial channel 76.

As stated above the cylindrical assembly 50 is joined to a cam lock assembly 20. The lock assembly 20 is comprised of a lock mechanism 21, and a cam unit 30. The lock mechanism 21 is a conventional key 2 operated lock with internal indents (not shown) to hold the key rotational turn at either 0° or 90°. The lock mechanism 21 has a rear portion 22 adapted to receive a key 2, a forward portion 23 and a cylindrical body 24 defined by said rear and forward portions 22, 23. The lock mechanism 21 has a circular threaded opening 26 formed in its wall 63. The opening 26 is adapted to receive a threaded plug 75. The longitudinal axis of the lock mechanism 21 is defined from the rear portion 22 to the forward portion 23. The lock mechanism central longitudinal axis is concentric with the central longitudinal axis of the cylindrical assembly 50. The forward portion 23 has a central, generally rectangular block element 25 protruding outward therefrom in a forward direction along the central longitudinal axis of the lock mechanism 21. The lock mechanism 21 is so constructed that movement of the key 90° causes a direct corresponding turn of the block element 25.

The lock mechanism forward block element 25 fits into the cam unit 30. The cam unit 30 has a rear wall 31 from which cylindrical side walls 32 extend horizontally forward, said cam unit 30 being generally cylindrical in shape, the longitudinal axis of said cam unit 30 being generally perpendicular to the rear wall 31 of said cam unit 30, said cam unit 30 having a front wall 33 connected to said cylindrical side walls 32, said front wall 33 being generally parallel to said rear wall 31. The cam unit rear wall 31 has a generally rectangular, central aperture 34 formed therein, said aperture 34 adapted to receive the lock mechanism forward block element 25. The cam unit front wall 33 has an elongated central slot 35 formed therein. The slot 35 and aperture 34 each have a longitudinal axis perpendicular to the cam unit 30 longitudinal axis.

The external diameters of the lock mechanism 21 and cam unit 30 are approximately the same. The external diameters of the lock mechanism 21 and cam unit 30 are slightly less than the diameter of the encasement element entry end interior 58, but greater than the diameter of the encasement element exit end interior 59. The lock assembly 20 is adapted to fit substantially into the encasement element entry end interior 58, cam unit front wall 33 first. The lever element cylindrical shafts 86 fit into the cam unit front wall slot 35. The lock mechanism body threaded opening 26 is aligned with the encasement element circular opening 74. A plug 75 threadingly engages the two openings 26, 74 and thereby holds the cam lock assembly 20 in place within the encasement element interior 64.

Figure 1B:
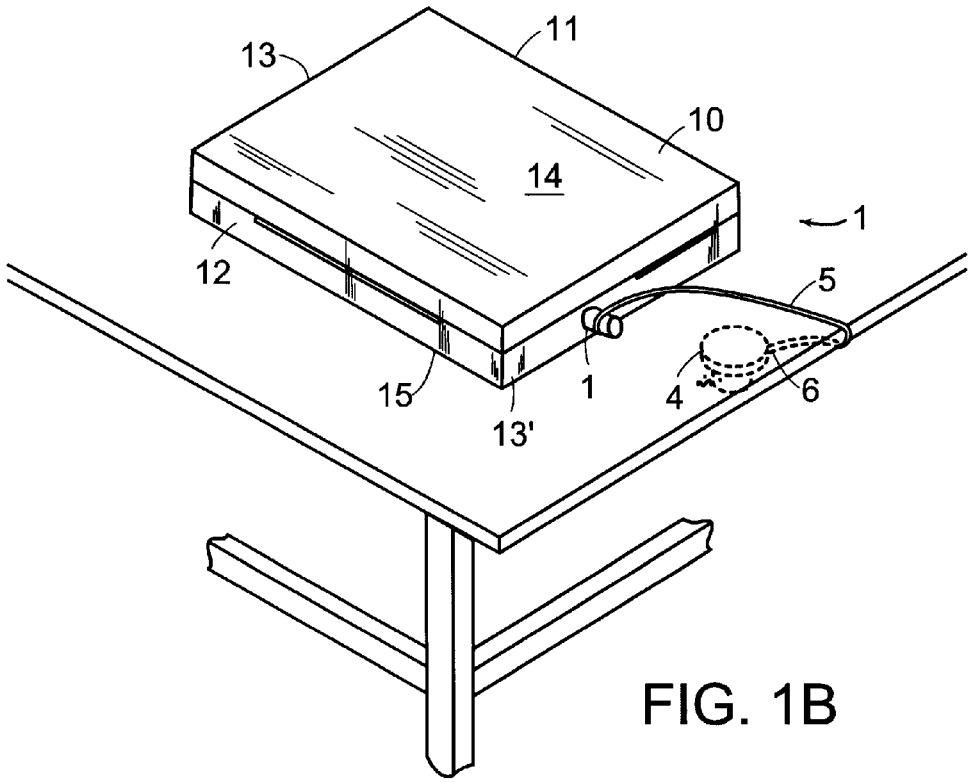
FIG. 1B is a perspective view of the invention, with an office anchor cable, installed on a notebook computer, thereby securing the notebook computer to a work surface.
Figure 2:
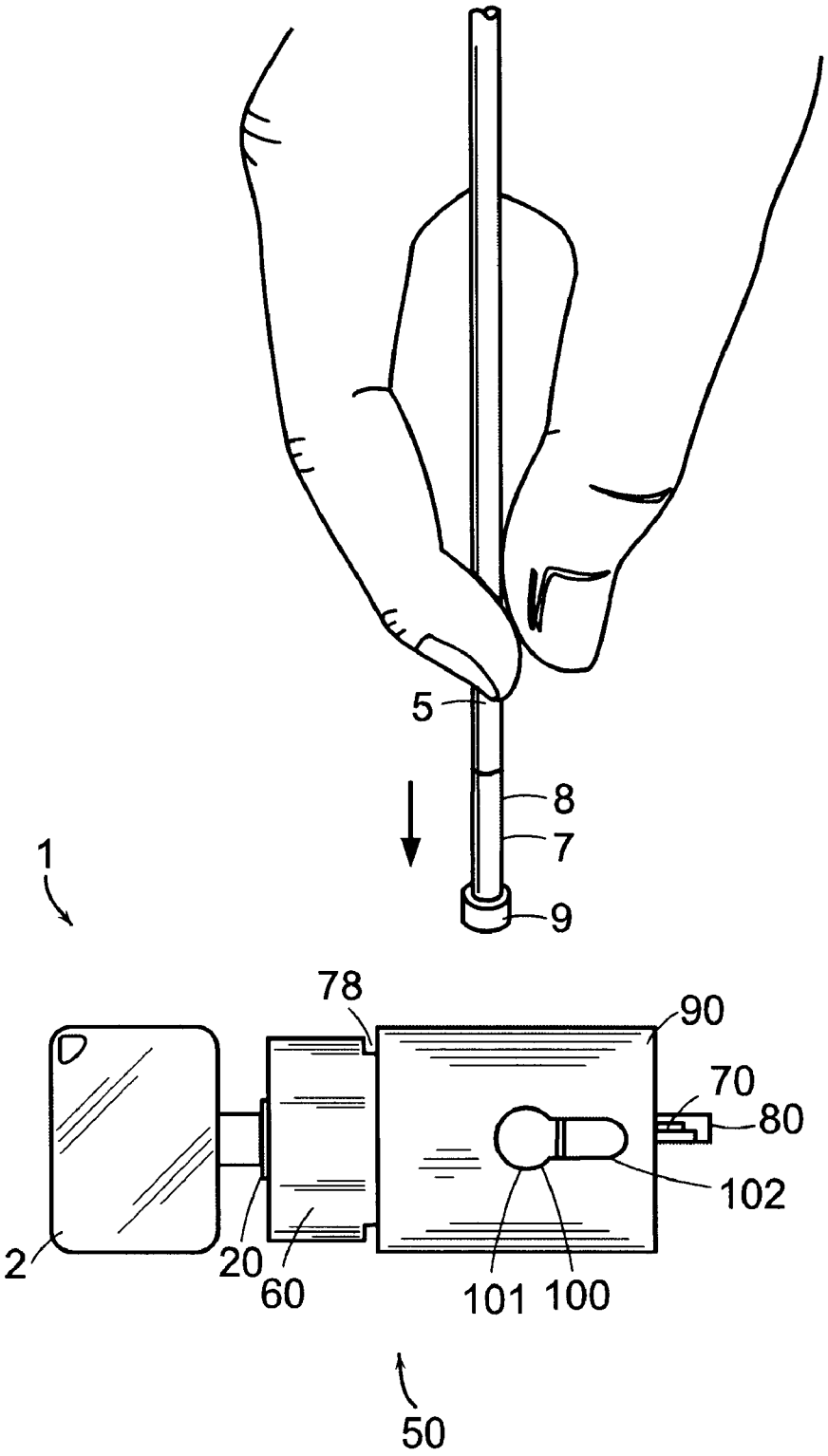
FIG. 2 is a close up view of the cylindrical assembly before installation of an anchor cable.
Figure 3:
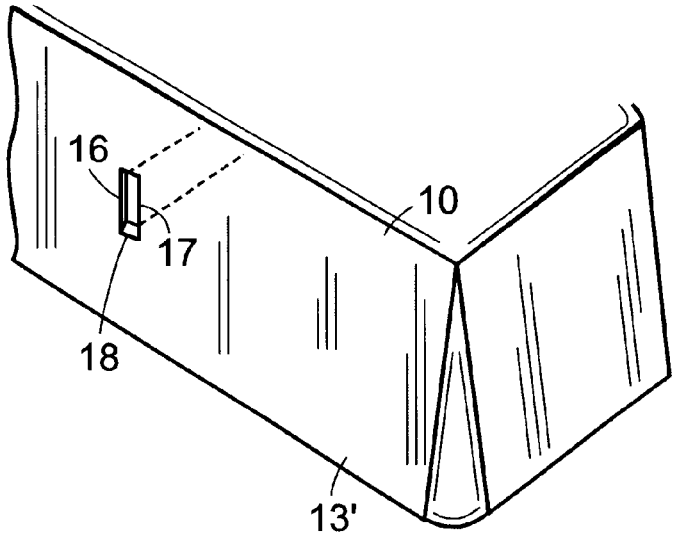
FIG. 3 is a close up perspective view of a computer open security slot.
Figure 4:
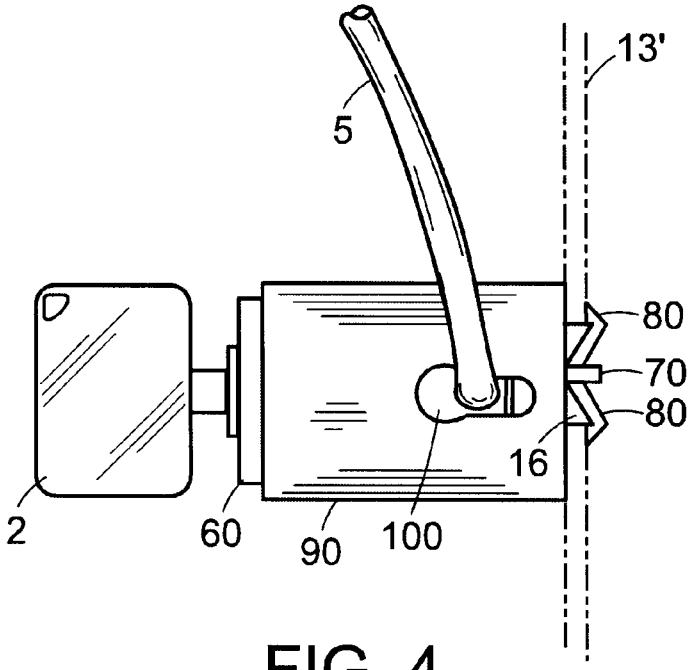
FIG. 4 is a close up view of the cylindrical assembly after installation of an anchor cable therein.
Figure 5:
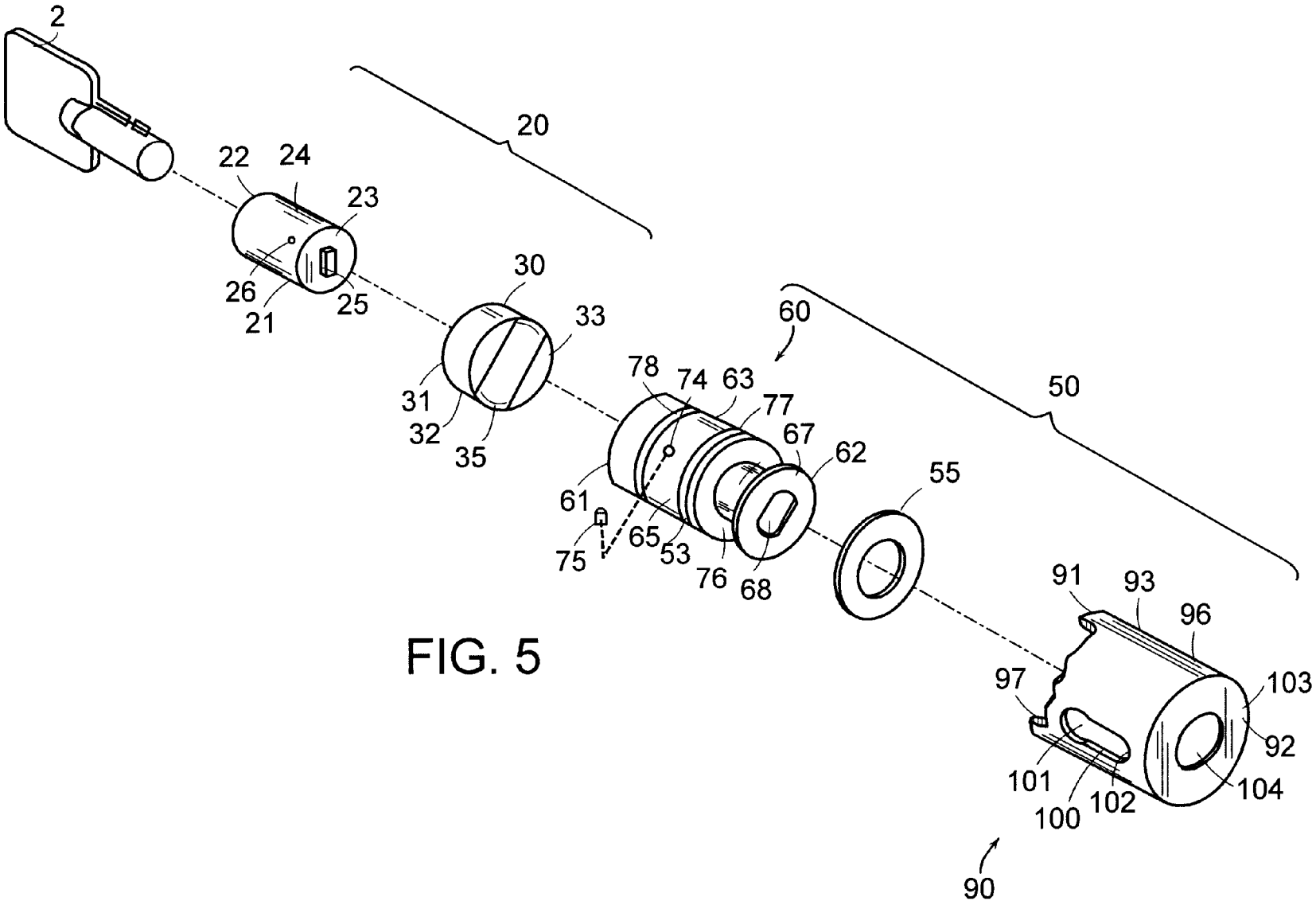
FIG. 5 is a close up, exploded view of the invention.
Figure 6:
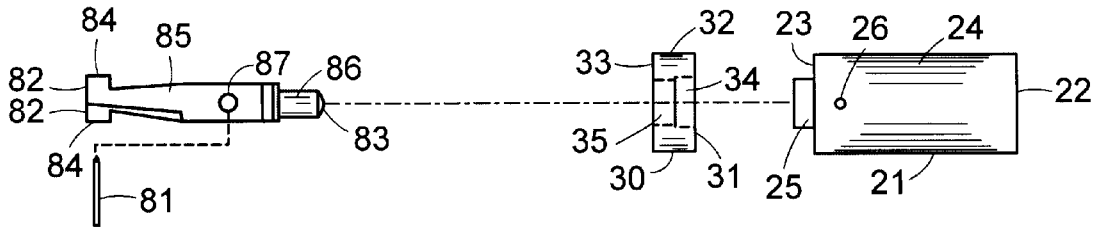
FIG. 6 is a side elevational view, partly exploded, of the invention lock assembly, cam cylinder and invention levers.

The cylindrical assembly 50 and lock assembly 20 combination is used in conjunction with an anchored locking cable 5. The locking cable 5 has two ends, an anchored end 6 and a holding end 7. As may be seen in FIGS. 1A, 1B and 2, the cable anchored end 6 may terminate in a simple slip knot and wrapped around a secure object such as a table leg 3. The cable anchored end 6 may also be attached to a special adaptor 4 glued to a secure object such as the underside of a desk. Any number of anchor cables having different anchored ends 6 may be used with the present invention. As may be seen additionally from FIGS. 2 and 4, the holding end 7 of the cable is comprised of a cylindrical shank 8 terminating in a disk-like protrusion 9 having a diameter greater than said shank 8. When the lock mechanism 21 is in the "unlocked" position, the encasement element radial channel 76 is concentric with the collar element key hole circular portion 101. The cable holding end disk-like protrusion 9 is inserted through the collar element key hole circular portion 101 into the encasement element radial channel 76. The encasement element 60 is then pushed further into the collar element 90, thereby causing the radial channel 76 to slide under the key hole rectangular portion 102, thereby capturing the cable disk-like protrusion 9 within the invention 1. The anchor cable disk-like protrusion 9 has a diameter greater than the width of the keyhole rectangular portion 102 but less than the diameter of the keyhole circular portion 101.

In operation, the anchor cable 5 is installed as described above. The cylindrical element forward end 51, comprising the protruding members 70 and level element forward ends 82, are inserted into computer open security slot 16. The key 2 is then turned 90°. The lock mechanism forward block element 25 will turn 90°, thereby turning the cam unit 30 90°. The cam unit slot 35 will thereby turn, causing a "camming" action on the lever element cylindrical shafts 86 thereby causing the lever bodies 85 to pivot in opposite directions. This results in the one lever element forward end 82 moving toward a security slot edge 17 and the other lever element forward end 82 moving toward the opposite security slot edge 17'.

Figure 7A:
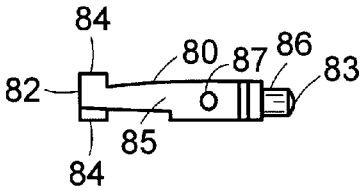
FIG. 7A is a front view of the cam cylinder force field with levers in an unlocked configuration.
Figure 7A:
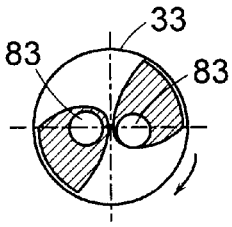
Figure 8A:
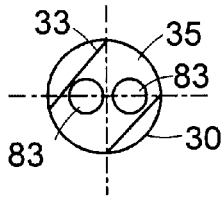
FIG. 8A is a front view of the cam cylinder with lever rearward ends in an unlocked position.
Figure 7B:
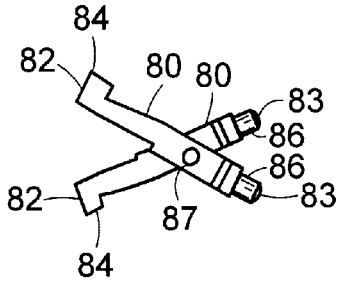
FIG. 7B is a front view of the cam cylinder force field with levers in a locked configuration.
Figure 7B:
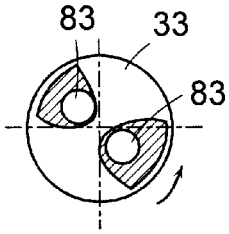
Figure 8B:
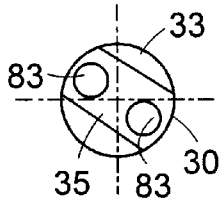
FIG. 8B is a front view of the cam cylinder with lever rearward ends in a locked position.
Figure 8C:
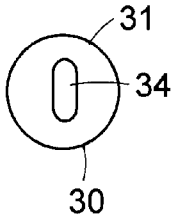
FIG. 8C is a rear view of the cam cylinder.
Figure 9A:
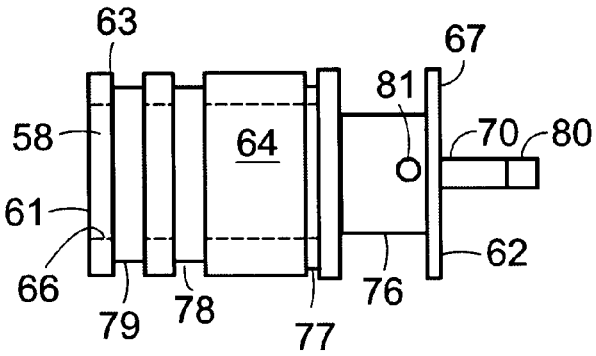
FIG. 9A is a top view of the invention cylindrical encasement element.
Figure 9B:
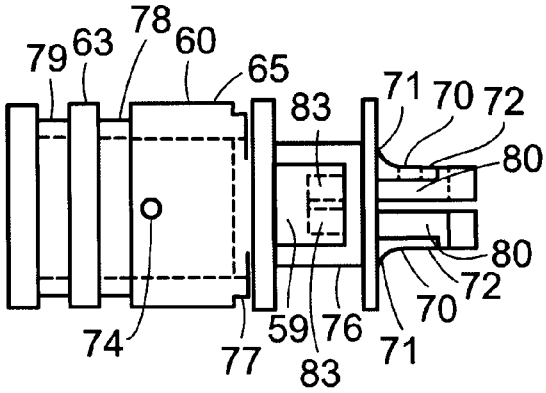
FIG. 9B is a side view of the encasement element of FIG. 9A.
Figure 9C:
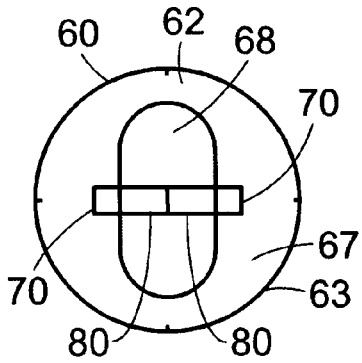
FIG. 9C is a front view of the encasement element of FIG. 9A.
Figure 10A:
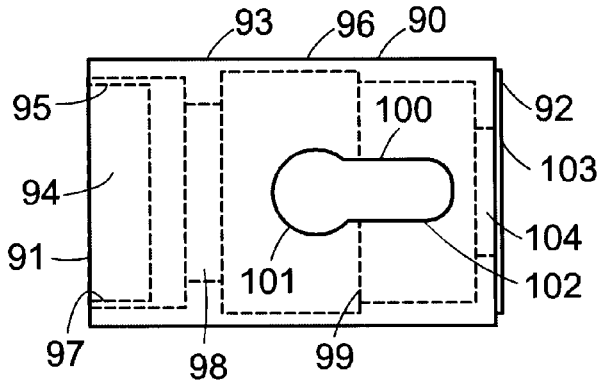
FIG. 10A is a side view of the invention collar element.
Figure 10B:
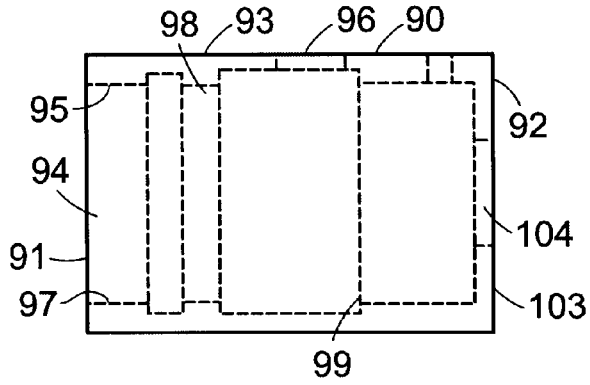
FIG. 10B is a top view of the collar element of FIG. 10A.
Figure 10C:
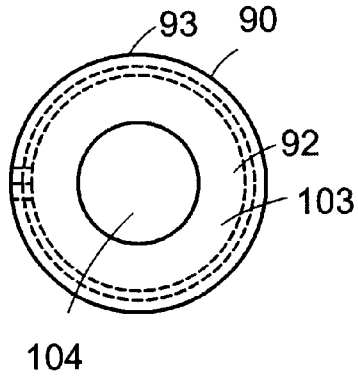
FIG. 10C is a front view of the collar element of FIG. 10A.
Figure 11A:
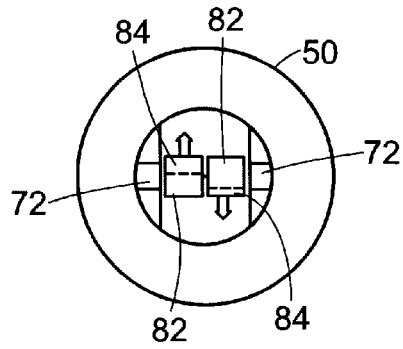
FIG. 11A is a partial front view of the cylindrical assembly in an unlocked mode.
Figure 11B:
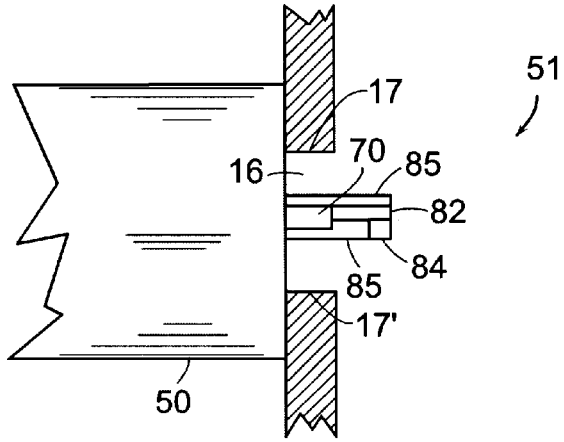
FIG. 11B is a partial side view of the cylindrical assembly of FIG. 11A inserted into a computer security slot.
Figure 11C:
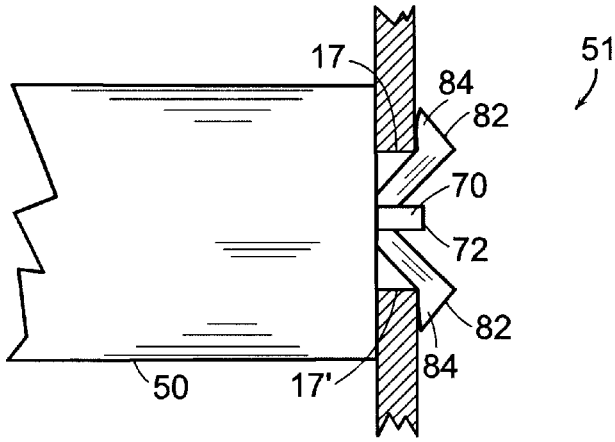
FIG. 11C is a view of the cylindrical assembly of FIG. 11B in a locked mode.

FIGS. 7A and 7B illustrate the force exerted by the cam unit front slot 35 on the lever rearward ends 83, while FIGS. 8A and 8B illustrate the actual corresponding movement of the slot 35 against the lever rearward ends 83. FIGS. 7A and 8A show the cam unit 30 positioned so that the levers 80 are generally parallel and in an "unlocked" mode. FIGS. 7B and 8B illustrate the cam unit 30 being turned 90° to the "locked" mode, and the consequent affect on the lever rearward ends 83 causing the levers 80 to scissor about the pin 81. The lever element half cross bars 84 will engage each of the edges 17 or 17'. The protruding members free ends 72 will protrude into the security slot 16 and prevent the lever elements 80 from disengaging. See FIGS. 11A, 11B and 11C.

The encasement element shallow channels 77, 78, 79 "O" ring 53 and collar element interior flanges 97, 98 provide a means for "locking" the cable 5 in place. The "O" ring 53 may be inserted into one of the encasement element shallow channels 77, 78, 79. With an "O" ring 53 installed in one of the channels 77, 78, 79 the "O" ring 53 will engage one of the collar interior flanges 97, 98. If the "O" ring 53 is installed in the encasement element forward channel 77, it will engage the collar element second interior flange 98 thereby permitting the cable 5 to be removed whenever the cam lock assembly 20 is removed from the computer security slot 16. However, if the "O" ring 53 is installed in the encasement element rearward channel 79, it will engage the collar element first interior flange 97 thereby holding the cable 5 in a "locked" position even if the cam lock assembly 20 is not installed in the computer security slot 16.

It is understood that the above-described embodiment is merely illustrative of the application. Other embodiments may be readily devised by those skilled in the art which will embody the principles of the invention and fall within the spirit and scope thereof.

I claim:

1. A security lever locking assembly adapted to operate in combination with a computer having a front wall, rear wall, two side walls, a top wall, and a bottom wall, one of said walls having an open security slot formed therein, comprising:

a cylindrical assembly with a front portion adapted to being inserted into said security slot, said front portion being comprised of two elongated lever elements positioned between two externally protruding, fixed, parallel members, each said lever element terminating in a half crossbar, each said lever element being pivotally attached to the cylindrical assembly, said lever elements being adapted to being pivoted in a scissors motion within the security slot by a camming action of a cam lock;

an anchored locking cable removably joined to said cylindrical assembly;

a cam lock assembly joined to said cylindrical assembly, wherein said cam lock assembly is comprised of:

a key operated lock mechanism with internal indents adapted to hold a key rotational turn at either 0° or 90°, said lock mechanism having a rear portion adapted to receive the key, a forward portion and a cylindrical body defined by said rear and forward portions, said lock mechanism having a circular threaded opening formed in its wall, said threaded opening adapted to receive a threaded plug, said rear portion and forward portion defining a lock mechanism longitudinal axis, said lock mechanism longitudinal axis being concentric with a central longitudinal axis of the cylindrical assembly, said lock mechanism forward portion having a central, generally rectangular block element protruding outward therefrom in a forward direction along a forward central longitudinal axis of the lock mechanism, said lock mechanism being adapted to cause a radial turn of the block element with a radial movement the key 90°; and a cam unit adapted to receive the block element, said cam unit having a rear wall from which cylindrical side walls extend horizontally forward, said cam unit being generally cylindrical in shape, said cam unit having a longitudinal axis generally perpendicular to the rear wall, said cam unit having a front wall connected to said cylindrical side walls, said front wall being generally parallel to said rear wall, said cam unit rear wall having a generally rectangular, central aperture formed therein, said aperture adapted to receive the lock mechanism forward block element, said cam unit front wall having an elongated central slot formed therein, said slot and aperture each have a longitudinal axis perpendicular to the cam unit longitudinal axis.

2. A security lever locking assembly as recited in claim 1, wherein said cylindrical assembly is comprised of:

a hollow cylindrical encasement element having two ends, an open entry end and an exit end, and a cylindrically curved wall extending from the entry end to the exit end, said entry end, exit end and wall defining a hollow interior, said wall having an exterior surface and an interior surface, said exit end being closed with a flat end wall having a small, central, elongated opening therein, said end wall having two externally protruding, parallel members, each positioned centrally adjacent an opposite elongated opening long edge, each said protruding member having an end attached to the end wall and an opposite free end, said protruding members each having a longitudinal axis defined from the attached end to the opposite free end, said longitudinal axis of each protruding member being perpendicular to a plane of the end wall and parallel to the cylindrical encasement element longitudinal central axis, said encasement element having a relatively deep, radial channel formed in the wall exterior surface near to the encasement element exit end, said encasement element having three, relatively shallow, radial channels formed in the wall exterior surface, one forward near to the deep channel, a second between the first channel and the encasement element entry end, and the third rearward toward the encasement element entry end, said shallow channels being adapted to receive an "O" ring, said encasement element interior being formed into two sections, an entry end interior and an exit end interior, said exit end interior being that portion of the encasement element defined by the deep radial channel and exit end, said exit end interior having a diameter less than an entry end interior diameter, said encasement element having said two elongated lever elements positioned between the two externally protruding, parallel members, extending through the exit end opening into the encasement element interior, said lever elements being pivotally pinned in position by a pin extending through the radial channel portion of the encasement wall, each said lever having a body defined by rearward end positioned within the encasement element interior and a forward end protruding out of the encasement element between the protruding members and terminating in a half crossbar giving the lever the general shape of an inverted "L", each said lever having a longitudinal axis defined by the rearward end and the forward end, said longitudinal axis of each lever in an unlocked positioned being generally perpendicular to the plane of the end wall and parallel to the cylindrical encasement element longitudinal central axis, each said lever body having a generally rectangular cross-section, each lever rearward end terminating in a cylindrical shaft with a central axis coincident with the longitudinal central axis of the lever, each lever body having an aperture formed through it at each lever's approximate longitudinal midpoint, each said lever being adapted to pivotally rotate about the pin positioned through the aperture, one lever pivoting in one direction and the other lever pivoting in an opposite direction, thereby forming a scissor crossing effect, the body of each lever element being substantially contained within the encasement element exit end interior, each lever cylindrical shaft protruding into the encasement element entry end interior; and a hollow cylindrical collar element positioned over said encasement element;

wherein said encasement element and collar element have concentric central axes defining longitudinal axes for each element.

3. A security lever locking assembly as recited in claim 2, wherein:

the lock mechanism and cam unit each have an external diameter of approximately the same dimension, said external diameters of the lock mechanism and cam unit being slightly less than the diameter of the encasement element entry end interior and greater than the diameter of the encasement element exit end interior, said lock assembly being adapted to fit substantially into the encasement element entry end interior, cam unit front wall first, each said lever element cylindrical shaft fitted into the cam unit front wall slot, said lock mechanism body threaded opening being aligned with the encasement element circular opening.

4. A security lever locking assembly as recited in claim 3, wherein:

said hollow, cylindrical collar element has two ends, one termed an entry end and the other termed an exit end, said entry end and exit end defining a collar element longitudinal axis, said collar element being shaped and formed by a cylindrically curved, wall extending from the entry end to the exit end, said wall, entry end and exit end defining a collar element interior, said collar element entry end being open, said wall having an interior surface and an exterior surface, said wall interior surface having a radial diameter slightly larger than a radial diameter of the encasement element wall exterior surface, said collar interior wall surface having three interior, radial flanges formed therein, a first flange being positioned at the collar element entry end, a second flange being formed approximately one-third of the length along the longitudinal axis from the entry end toward the exit end, and a third flange being formed approximately two-thirds of the length along the longitudinal axis from the entry end toward the exit end, said collar element wall having a keyhole-shaped opening formed therein, said opening having a circular portion and a generally rounded, rectangular portion, said keyhole opening having a longitudinal axis parallel to the collar element longitudinal axis, said keyhole circular portion being closest to the collar element entry end, said keyhole rectangular portion being closest to the collar element exit end, said collar element exit end being partly closed with an end wall having a central circular opening formed therein;

wherein the collar element entry end is adapted to being placed over the encasement element exit end and partly over the encasement element wall exterior surface so that the encasement element protruding members and lever forward ends protrude through the collar element end wall circular central opening; and wherein the encasement and collar elements are adapted to being fitted so that the collar element keyhole opening is positioned over the encasement element radial channel.

5. A security lever locking assembly as recited in claim 4, wherein:

the anchored locking cable has two ends, an anchored end and a holding end, said cable holding end being comprised of a cylindrical shank terminating in a disk having a diameter greater than said shank, said disk having a diameter greater than the width of the keyhole rectangular portion and less than the diameter of the keyhole circular portion.

6. A security lever locking assembly as recited in claim 5, further comprising:

a resilient buffer washer sandwiched between the encasement element end wall and the collar element end wall within the collar element interior wall surface over the encasement element protruding members.

7. A security lever locking assembly as recited in claim 6, wherein:

the locking assembly is adapted to receive a key, said key adapted to being turned 90°, wherein said lock mechanism forward block element is adapted to being turned 90°, thereby turning the cam unit 90°, said cam unit slot adapted to thereby turn, causing a camming action on the lever element cylindrical shafts thereby causing the lever bodies to pivot in opposite directions.

* * * * *